United States Patent [19]

Borglum

[11] 4,140,076

[45] Feb. 20, 1979

[54] PEDAL WELL FOR A PADDLE WHEEL BOAT

[76] Inventor: Keith B. Borglum, 218 Loma, Waterloo, Iowa 50701

[21] Appl. No.: 830,125

[22] Filed: Sep. 2, 1977

[51] Int. Cl.[2] ..... B63H 16/00; G01C 22/00

[52] U.S. Cl. ..... 115/26; 114/61

[58] Field of Search ..... 114/39, 61, 182, 183 R; 115/21, 22, 25, 26

[56] References Cited

U.S. PATENT DOCUMENTS 3,459,150 8/1969 Lunde ..... 114/183 R 3,648,644 3/1972 Smith ..... 115/26

*Primary Examiner*—Trygve M. Blix
*Assistant Examiner*—D. W. Keen
*Attorney, Agent, or Firm*—Henderson, Sturm, Cepican & Fix

[57] ABSTRACT

A foot operated paddle wheel boat including a foot pedal well having a floor disposed above the water line and a drain opening disposed in the floor. The drain opening, being above the water line when the boat is in the water, continuously drains water from the pedal well.

2 Claims, 6 Drawing Figures

PEDAL WELL FOR A PADDLE WHEEL BOAT

BACKGROUND OF THE INVENTION

The present invention relates generally to foot operated paddle wheel boats and more particularly to the pedal well of such a boat. The pedal well is the cavity which accommodates the eccentric extension of the paddle wheel shaft and the feet and legs of the operator.

In boats of this nature, the pedal well may fill with rain water or water that is splashed into the boat. Since the lowermost portion of the pedal well has been located below the water line, the boat must be raised out of the water to drain the well. This draining operation is cumbersome and results in inefficient use of the boat. Those concerned with this problem recognize the need for a more efficient method of draining the water from the pedal well.

SUMMARY OF THE INVENTION

The instant invention provides a foot operated paddle wheel boat having a pedal well disposed such that the floor of the pedal well is above the water line when the boat is in the water. An opening in the floor, therefore, provides a continuous means of draining water from the pedal well.

An object of the present invention is the provision of an improved foot operated paddle wheel boat.

Another object is to provide a pedal well, in a paddle wheel boat, which can be continuously drained while the boat remains in the water.

A further object of the invention is the provision of a foot operated paddle wheel boat which is efficient to operate.

Other objects, advantages, and novel features of the present invention will become apparent from the following detailed description of the invention whem considered in conjunction with the accompanying drawings.

DESCRIPTION OF THE PREFERRED EMBODIMENT

Figure 1:
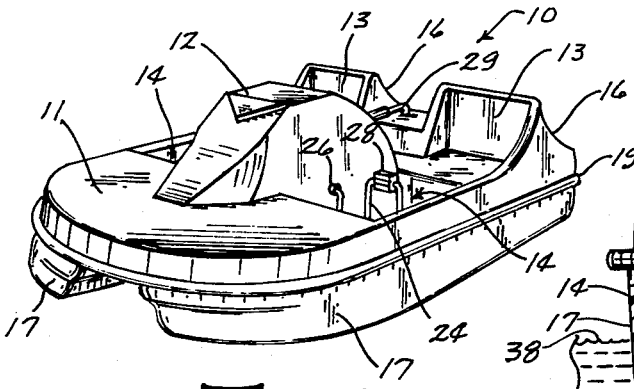
FIG. 1 is a perspective view of a foot operated paddle wheel boat using the pedal well of the instant invention.

Referring now to the drawings, wherein like reference numerals designate identical or corresponding parts throughout the several views, FIG. 1 shows a foot operated paddle wheel boat generally designated by the reference numeral 10.

Figure 2:
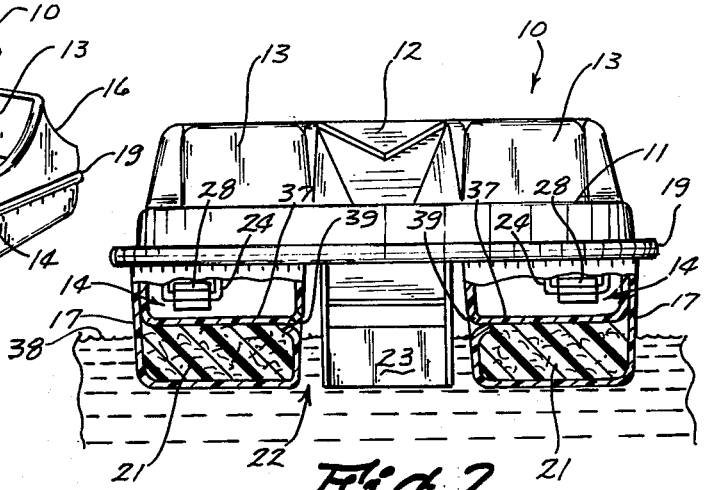
FIG. 2 is a front elevational view having portions cut away to show the position of the pedal well relative to the underlying portion and relative to the water level.
Figure 4:
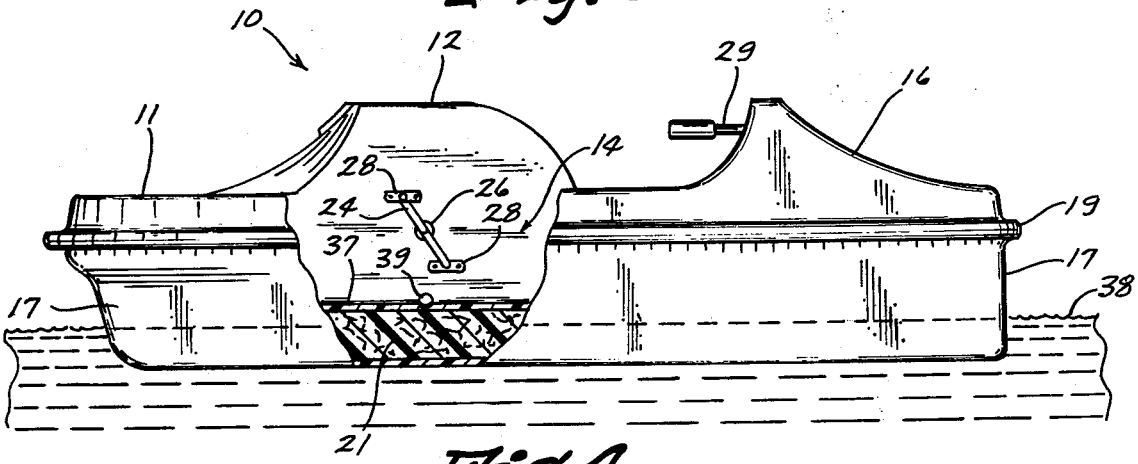
FIG. 4 is a side elevational view having a portion cut away to show the pedal well.
Figure 5:
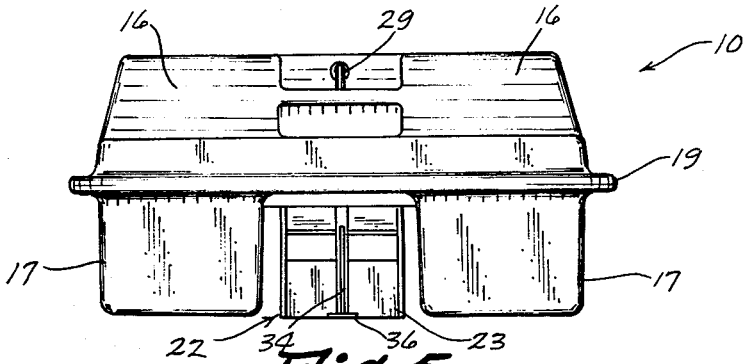
FIG. 5 is a rear elevational view.

Although the boat 10 can be constructed in any suitable manner, the embodiment illustrated in the drawings includes an integrally formed reinforced fiberglas upper shell having a fore deck 11, a paddle wheel housing 12, seat members 13, pedal wells 14, and a sloping rear deck 16. A pair of integrally formed reinforced fiberglas pontoons 17 are attached to the upper shell by fasteners 18 and a protective resilient moulding 19 extends around the outside edge of boat 10. As shown in FIGS. 2 and 4, the pontoons 17 are filled with foam 21 and, therefore, never need to be drained.

Figure 3:
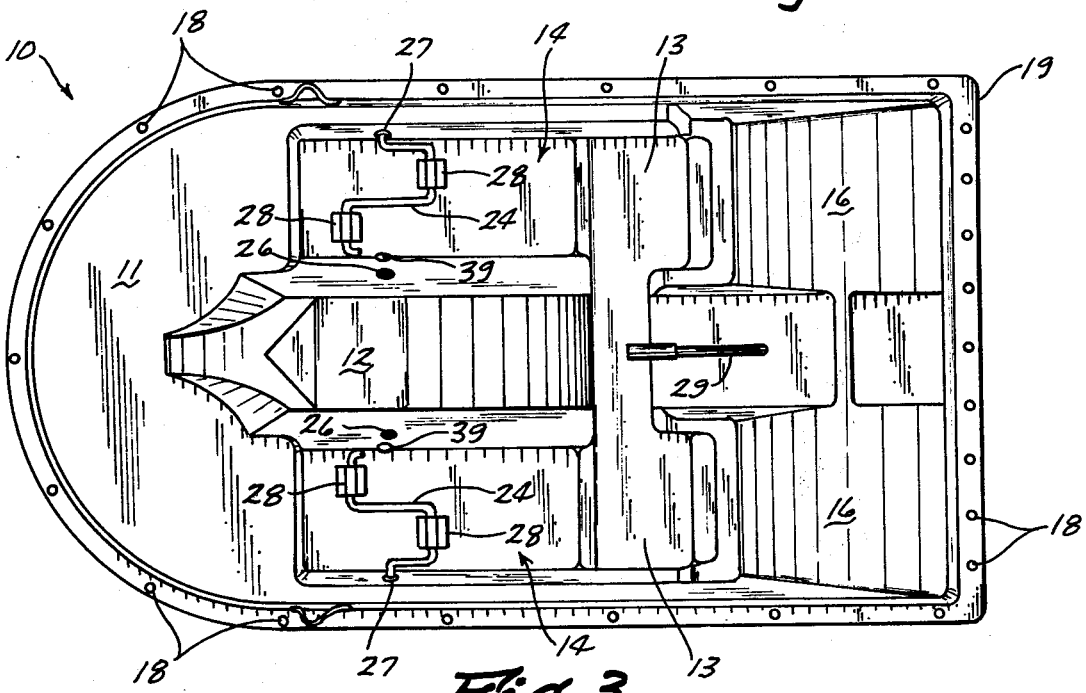
FIG. 3 is a top plan view having portions of the pedal shaft cut away to show the preferred location of the pedal well drain.

The boat 10 is propelled by paddle wheel 22 (FIG. 6) having paddles 23 and being mounted on shaft 24. Shaft 24 extends through bearings 26 mounted in the opposite sidewalls of housing 12 and the opposite ends of shaft 24 are journaled in bearings 27 mounted in the outer sidewalls of pedal wells 14. Shaft 24, thus, extends transverse to pedal wells 14 and foot pedals 28 are rotatably mounted on the eccentric portions of shaft 24 as most clearly shown in FIG. 3. Paddle wheel 22 is therefore rotated by the direct drive of shaft 24 rotated by the movement of foot pedals 28.

Figure 6:
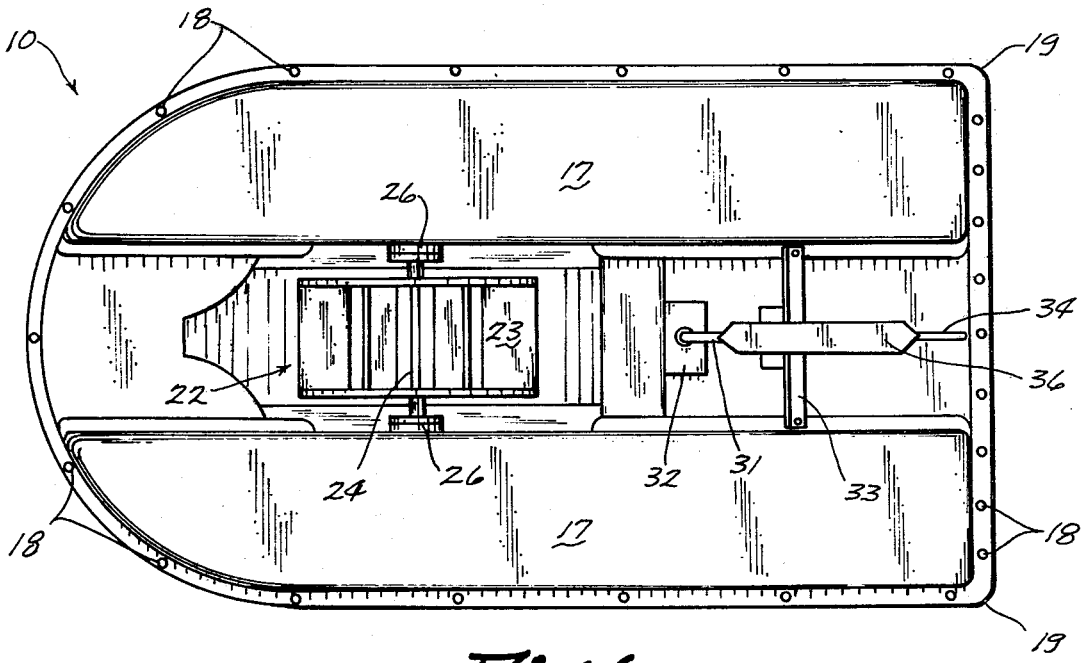
FIG. 6 is a bottom plan view.

The rudder arm 29 is located between the seat members 13 so that either occupant can steer the boat 10. As shown in FIG. 6, the rudder post 31 extends downward and rearward from mounting plate 32 and is rotatably attached to strap 33. The rudder blade attached to post 31 includes a flat vertical blade 34 and a horizontal blade 36 attached to the lower edge of blade 34. Since the axis of the rudder post 31 is fixed at an inclined angle, rotation of post 31 causes the rearmost portion of blade 34 to move transversely downward so that it clears the pontoons 17 when in the far left or far right position.

Referring now to FIGS. 2 and 4, the pedal well 14 includes a horizontal floor 37 which is disposed above the foam filled portion of pontoon 17 and above the water level 38. A drain opening 39 is formed in floor 37 and allows water to continuously drain from the pedal well 14. It is understood that a standard plug could be used in conjunction with drain opening 39 but it is not necessary to do so since the opening 39 is disposed above the water level at all times.

The drain opening 39 is located in the radius between the floor 37 and the sidewall of housing 12. This location allows the water to drain without interference with the pontoon 17 and makes the opening 39 less noticeable. It is understood that the drain opening 39 could be located at any point in the pedal well 14, even above the floor 37. The location being dependent upon whether or not it is desirable to completely or partially drain the pedal well 14.

Obviously many modifications and variations of the present invention are possible in light of the above teachings. It is therefore to be understood that, within the scope of the appended claims, the invention may be practiced otherwise than as specifically described.

I claim:

1. A foot operated paddle wheel boat comprising an upper shell having a pair of contoured pedal wells having an interior side wall and exterior side wall and a generally horizontal floor, said interior side walls forming a paddle wheel housing between said pedal wells, a pair of bouyant pontoons attached to the underside of said upper shell;

said pair of pedal wells disposed directly above said pontoons, the lower most portion of said floor being disposed above the water level when said boat is in the water; and a drain opening formed in said interior wall of each pedal well adjacent said generally horizontal floor and opening into a space between said pair of bouyant pontoons, whereby water can continuously drain from said pedal well when said boat is in the water.

2. A foot operated paddle wheel boat as in claim 1; wherein, said drain opening formed in said interior wall extends into said generally horizontal floor, and is angled with respect to both said interior wall and generally horizontal floor.

* * * * *